US009417565B2

(12) United States Patent
Hozumi et al.

(10) Patent No.: US 9,417,565 B2
(45) **Date of Patent: *Aug. 16, 2016**

(54) CONVEYOR SYSTEM AND IMAGE FORMING APPARATUS INCLUDING SAME

(71) Applicant: RICOH COMPANY, LTD., Tokyo (JP)

(72) Inventors: Yoshiki Hozumi, Kanagawa (JP); Naoki Iwaya, Tokyo (JP); Yasufumi Takahashi, Kanagawa (JP); Masaharu Furuya, Kanagawa (JP); Naomi Sugimoto, Kanagawa (JP); Kazuchika Saeki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/789,606

(22) Filed: Jul. 1, 2015

(65) Prior Publication Data

US 2015/0301484 A1 Oct. 22, 2015

Related U.S. Application Data

(63) Continuation of application No. 14/507,087, filed on Oct. 6, 2014, now Pat. No. 9,104,162.

(30) Foreign Application Priority Data

Oct. 31, 2013 (JP) ..... 2013-226279

(51) Int. Cl.
*G03G 15/00* (2006.01)
*B65H 3/06* (2006.01)
(Continued)

(52) U.S. Cl.
CPC ..... *G03G 15/1615* (2013.01); *B65H 3/06* (2013.01); *B65H 3/0669* (2013.01); *B65H 5/023* (2013.01);
(Continued)

(58) Field of Classification Search
CPC ..... G03G 15/6529; G03G 15/161; G03G 15/1615; G03G 15/1605; G03G 2215/00143; G03G 2215/00156; B65H 3/06; B65H 3/0669; B65H 5/023
See application file for complete search history.

(56) References Cited

U.S. PATENT DOCUMENTS 4,750,608 A 6/1988 Harpold
8,406,665 B2 3/2013 Hirose et al.
(Continued)

FOREIGN PATENT DOCUMENTS

EP 1 357 439 A2 10/2003
JP 2001-147601 5/2001
(Continued)

OTHER PUBLICATIONS

Extended Search Report issued Apr. 1, 2015, in European Patent Application No. 14188161.5.
(Continued)

*Primary Examiner* — Gregory H Curran
(74) *Attorney, Agent, or Firm* — Oblon, McClelland, Maier & Neustadt, L.L.P

(57) ABSTRACT

A conveyor system includes a first conveyor belt entrained about a separation roller and a support roller disposed upstream from the separation roller, a second conveyor belt entrained about a first roller disposed at an uppermost stream in a transport direction of a sheet-type medium and a second roller disposed downstream therefrom, a belt alignment device to tilt a rotary shaft of the separation roller to restrict a range of belt mistracking of the first conveyor belt in a width direction thereof within a predetermined range, and a restriction member to restrict an amount of inclination of the rotary shaft such that a hypothetical extended plane, which is a hypothetical extension of the outer circumferential surface of the first conveyor belt between the separation roller and the support roller to a downstream side in the transport direction, does not contact a rotational center axis of the first roller.

3 Claims, 7 Drawing Sheets

MAXIMUM INCLINATION

(51) Int. Cl.
*B65H 5/02* (2006.01)
*G03G 15/16* (2006.01)

(52) U.S. Cl.
CPC ..... *G03G 15/657* (2013.01); *G03G 15/6529* (2013.01); *G03G 2215/00135* (2013.01); *G03G 2215/00143* (2013.01); *G03G 2215/00156* (2013.01)

(56) References Cited

U.S. PATENT DOCUMENTS

| | | | |
|---|---|---|---|
| 8,857,602 | B2 | 10/2014 | Clevers et al. |
| 2013/0306440 | A1 | 11/2013 | Asaoka et al. |
| 2013/0306441 | A1 | 11/2013 | Asaoka et al. |
| 2014/0008184 | A1 | 1/2014 | Hozumi et al. |
| 2014/0083821 | A1 | 3/2014 | Hozumi et al. |
| 2014/0183007 | A1 | 7/2014 | Hozumi et al. |
| 2014/0209437 | A1 | 7/2014 | Hozumi et al. |
| 2015/0125189 | A1 | 5/2015 | Hozumi et al. |

FOREIGN PATENT DOCUMENTS

| | | |
|---|---|---|
| JP | 2006-267243 | 10/2006 |
| JP | 2007-11107 A | 1/2007 |
| JP | 2009-86245 A | 4/2009 |
| JP | 2010-230958 | 10/2010 |
| JP | 2012-103286 | 5/2012 |

OTHER PUBLICATIONS

Office Action issued Oct. 16, 2015 in Japanese Patent Application No. 2013-226279.

IMMEDIATELY AFTER ASSEMBLY

AFTER ADJUSTMENT

IMMEDIATELY AFTER ASSEMBLY

MAXIMUM INCLINATION

⇒PAPER JAMS
MAXIMUM INCLINATION

MAXIMUM INCLINATION

IMMEDIATELY AFTER ASSEMBLY

CONVEYOR SYSTEM AND IMAGE FORMING APPARATUS INCLUDING SAME

CROSS-REFERENCE TO RELATED APPLICATIONS

The present continuation application claims the benefit of priority under 35 U.S.C. §120 to application Ser. No. 14/507,087, filed Oct. 6, 2014, and claims priority pursuant to 35 U.S.C. §119 to Japanese Patent Application No. 2013-226279, filed on Oct. 31, 2013, in the Japan Patent Office, the entire contents of which are hereby incorporated by reference herein.

BACKGROUND

1. Technical Field

Exemplary aspects of the present disclosure generally relate to a conveyor system that carries a sheet-type medium on a surface thereof and an image forming apparatus, such as a copier, a facsimile machine, or a printer including the conveyor system.

2. Description of the Related Art

There has been known a color image forming apparatus using an electrophotographic method in which toner images of different colors formed on latent image bearing members are primarily transferred onto an intermediate transfer member and then secondarily onto a sheet-type medium such as a recording medium in a secondary transfer process. There are two types of secondary transfer devices that performs the secondary transfer process employed in the image forming apparatus of this kind: a roller-transfer type and a belt-transfer type. The secondary transfer device of the roller-transfer type includes an intermediate transfer member and a transfer roller, and a sheet-type medium is interposed between the intermediate transfer member and the transfer roller, and is transported. The latent image is secondarily transferred onto the sheet-type medium while the sheet-type medium is transported.

The secondary transfer device of the belt-transfer type includes a conveyor belt (i.e., a secondary transfer belt) formed into an endless loop entrained about and stretched taut between support rollers. The sheet-type medium is interposed between the conveyor belt and the intermediate transfer member, and the latent image is secondarily transferred onto the sheet-type medium while the sheet-type medium is transported. In the secondary transfer device of the belt-transfer type, the sheet-type medium is interposed in a secondary transfer nip between the secondary transfer belt and the intermediate transfer member, and the sheet-type medium is absorbed to the secondary transfer belt upstream and/or downstream from the secondary transfer nip in the transport direction of the sheet-type medium. In this configuration, the sheet-type medium is held and transported reliably, not only at the secondary transfer nip, but also at the upstream side and the downstream side in the transport direction of the sheet-type medium. Thus, it is generally said that the belt-transfer type allows more reliable sheet conveyance than the roller-transfer type.

Similar to a generally-known belt conveyor, the belt transfer method may cause the secondary transfer belt to drift to one side in the width direction of the belt or repeatedly wander back and forth on either side in the width direction of the belt. Such belt wander and belt meander are attributed to dimensional tolerance of parts constituting the secondary transfer device, for example, variations in a parallelism error of rotary shafts of the plurality of rollers that supports the secondary transfer belt, variations in an outer diameter of the rollers, and variations in the tension of the secondary transfer belt due to changes in the circumferential length of the secondary transfer belt itself. More specifically, because of the reasons above, the secondary transfer belt does not travel linearly, but keeps traveling out of alignment in the width direction of the belt (i.e., the direction of the roller shaft), causing the belt to drift side to side.

In view of the above, various belt alignment devices that keep the belt on track have been proposed. One example of a known belt alignment device employs a shaft inclination method, in which a correction roller, around which the belt is entrained, capable of tilting, is employed to move the belt in the direction opposite the direction of the belt drift. However, the known belt alignment device of the shaft inclination method is disadvantageous when employed in a belt conveyor unit in which a sheet-type medium is carried successively on two or more conveyor belts arranged next to each other in the transport direction of the sheet-type medium.

For example, a sheet-type medium on a first conveyor belt disposed at the upstream side in the transport direction of the sheet-type medium is passed onto a second conveyor belt disposed downstream from the first conveyor belt. At this time, the leading end of the sheet-type medium separated from the surface of the first conveyor belt wound around a separation roller (support roller) disposed at the extreme downstream end in the transport direction of the sheet-type medium needs to land smoothly on the surface of the successive conveyor belt, that is, the second conveyor belt. If the leading end of the sheet-type medium does not land smoothly on the second conveyor belt, undesirable shock may be applied to the sheet-type medium, causing image failure on the sheet-type medium and paper jams, for example. Such difficulty becomes pronounced when using the belt alignment device of the shaft inclination method in which the degree of inclination of the separation roller is relatively large.

In view of the above, there is demand for an image forming apparatus capable of delivering smoothly the sheet-type medium from the first conveyor belt disposed at the upstream side in the transport direction of the sheet-type medium to the second conveyor belt disposed downstream from the first conveyor belt when using the belt alignment device of the shaft inclination method.

SUMMARY

In view of the foregoing, in an aspect of this disclosure, there is provided an improved conveyor system including a first conveyor belt, a second conveyor belt, a belt alignment device, and a restriction member. The first conveyor belt is formed into an endless loop, entrained about and stretched taut between a plurality of rollers including a separation roller including a rotary shaft and a support roller disposed upstream from the separation roller in a traveling direction of the first conveyor belt, and carries a sheet-type medium on an outer circumferential surface of the first conveyor belt. The second conveyor belt is formed into an endless loop, entrained about and stretched taut between a plurality of rollers including a first roller disposed at an uppermost stream in a transport direction of the sheet-type medium and a second roller disposed downstream from the first roller, and carries, on an outer circumferential surface of the second conveyor belt, the sheet-type medium separated from a wound portion of the first conveyor belt wound around the separation roller. The belt alignment device tilts the rotary shaft of the separation roller to restrict a range of belt mistracking of the first conveyor belt in a width direction of the first conveyor belt within a predetermined range. The restriction member restricts an amount of inclination of the rotary shaft of the separation roller such that a hypothetical extended plane, which is a hypothetical extension of the outer circumferential surface of the first conveyor belt between the separation roller and the support roller to a downstream side in the transport direction, does not contact a rotational center axis of the first roller.

According to another aspect, an image forming apparatus includes a latent image bearing member, an intermediate transfer member, and the conveyor system to transport a sheet-type medium onto which the image is transferred from the intermediate transfer member. The latent image bearing member bears an image on a surface thereof. The image is transferred from the latent image bearing member onto the intermediate transfer member.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
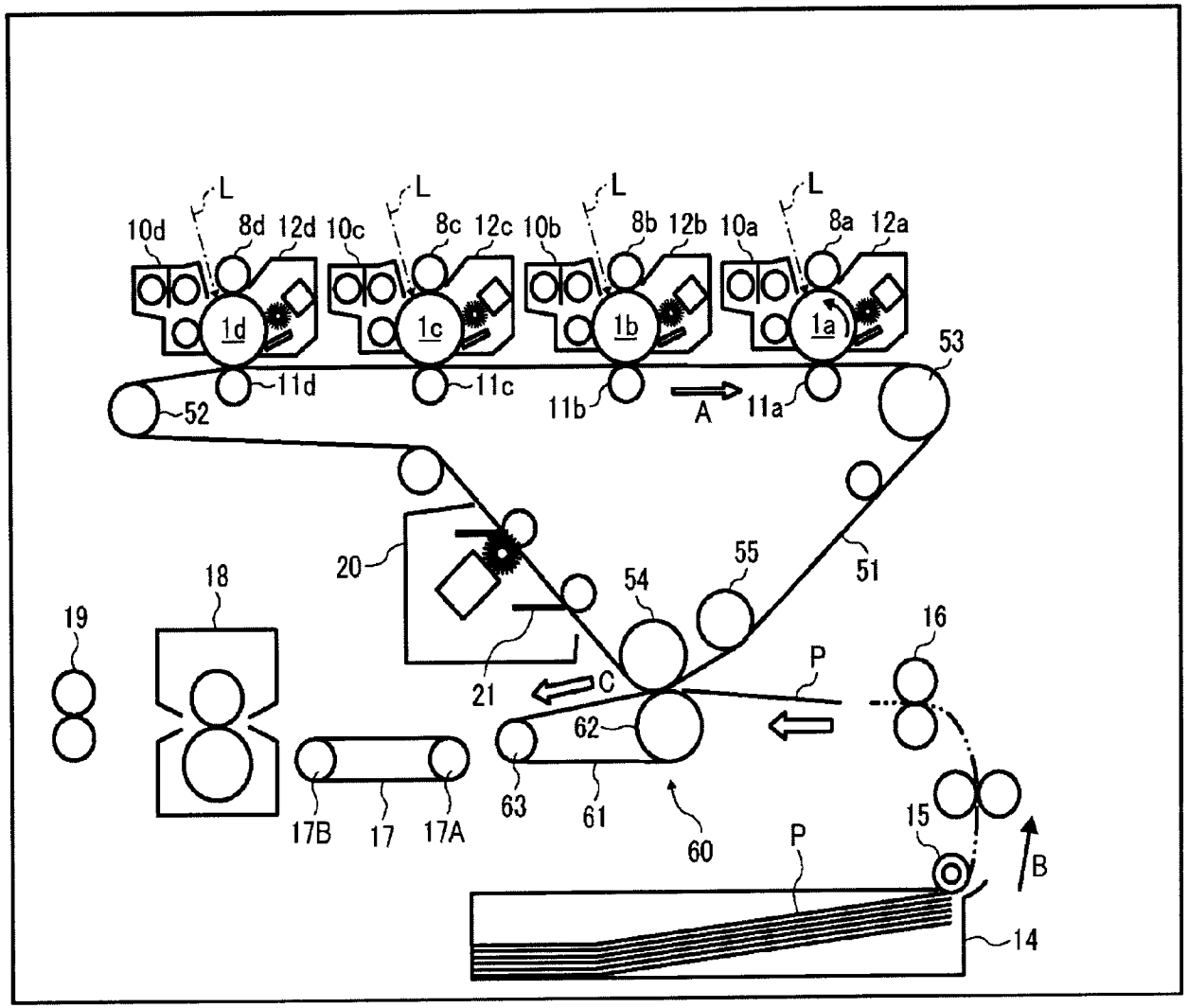
FIG. 1 is a schematic diagram illustrating a printer as an example of an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

With reference to FIG. 1, a description is provided of an example of an electrophotographic image forming apparatus according to an illustrative embodiment of the present disclosure. FIG. 1 is a schematic diagram illustrating the image forming apparatus. The image forming apparatus includes four photosensitive members 1*a*, 1*b*, 1*c*, and 1*d* disposed inside a main body housing of the image forming apparatus. Toner images of different colors are formed on the respective photosensitive members 1*a*, 1*b*, 1*c*, and 1*d*. More specifically, a black toner image, a magenta toner image, a cyan toner image, and an yellow toner image are formed on the photosensitive members 1*a*, 1*b*, 1*c*, and 1*d*, respectively. According to the present illustrative embodiment, the photosensitive members 1*a*, 1*b*, 1*c*, and 1*d* have a drum shape. Alternatively, the photosensitive members 1*a*, 1*b*, 1*c*, and 1*d* may employ an endless looped belt entrained about a plurality of rollers and driven to rotate.

The image forming apparatus includes an intermediate transfer belt 51 formed into an endless loop as an intermediate transfer member which serves as an image bearing member. The intermediate transfer belt 51 faces the four photosensitive members 1*a*, 1*b*, 1*c*, and 1*d*. The outer circumferential surface of each of the photosensitive members 1*a*, 1*b*, 1*c*, and 1*d* contacts the outer circumferential surface of the intermediate transfer belt 51. The intermediate transfer belt 51 is entrained about and stretched taut between a plurality of support rollers: a tension roller 52, a drive roller 53, a repulsive roller 54, an entry roller 55, and so forth. The drive roller 53, which is one of support rollers, is driven to rotate by a drive source, and rotation of the drive roller 53 causes the intermediate transfer belt 51 to travel in a direction of hollow arrow A in FIG. 1.

The intermediate transfer belt 51 may be a single-layer belt or a multi-layered belt. In the case of the multi-layered belt, a base layer of the belt may be formed of a relatively inelastic fluorine resin such as a polyvinylidene fluoride (PVDF) sheet and polyimide resin, with a smooth coating layer of fluorine resin deposited on the outer surface of the belt. In the case of a single-layer belt, the belt material may be selected from, for example, polyvinylidene difluoride (PVDF), polycarbonate (PC) and polyimide (PI).

The configuration and operation for forming toner images on each of the photosensitive members 1*a*, 1*b*, 1*c*, and 1*d*, all have a similar or the same configuration as all the others, differing only in the color of toner employed. Similarly, the configuration and operation for transferring primarily the toner images onto the intermediate transfer belt 51 have a similar or the same configuration as all the others, differing only the color of toner employed. Thus, a description is provided only of the photosensitive member 1*a* for forming a black toner image and its associated imaging equipment as an example of the photosensitive members and associated imaging equipment. The description of the photosensitive members 1*b*, 1*c*, and 1*d*, and associated imaging equipment are omitted herein, unless otherwise indicated.

The photosensitive member 1*a* rotates in the counterclockwise direction indicated by arrow in FIG. 1. The outer circumferential surface of the photosensitive member 1*a* is illuminated with light from a static eliminator, thereby initializing the surface potential of the photosensitive member 1*a*. The initialized surface of the photosensitive member 1*a* is charged uniformly by a charging device 8*a* to a predetermined polarity (in the present illustrative embodiment, a negative polarity). Similarly, the initialized photosensitive members 1*b*, 1*c*, and 1*d* are charged uniformly by charging devices 8*b*, 8*c*, and 8*d*. Subsequently, an exposure device illuminates the charged surface of the photosensitive member 1*a* with a modulated laser beam L, thereby forming an electrostatic latent image on the surface of the photosensitive member 1*a*. According to the present illustrative embodiment, the exposure device that projects the laser beam L includes a laser writing device. Alternatively, the exposure device may include an LED array and an imaging device. The electrostatic latent image formed on the photosensitive member 1*a* is developed with a respective color of toner, i.e., black, by a development device 10*a* into a visible image, known as a black toner image. Reference numerals 10*b*, 10*c*, and 10*d* also refer to development devices.

Primary transfer rollers 11*a*, 11*b*, 11*c*, and 11*d* serving as primary transfer devices are disposed inside the looped intermediate transfer belt 51, facing the photosensitive members 1*a*, 1*b*, 1*c*, and 1*d*, respectively. The primary transfer roller 11*a* contacts the inner circumferential surface of the intermediate transfer belt 51 to form a primary transfer nip between the photosensitive member 1*a* and the intermediate transfer belt 51. The primary transfer roller 11*a* is supplied with a primary transfer voltage having a polarity (in this example, a positive polarity) opposite a charge polarity of the toner image formed on the photosensitive member 1*a*, thereby forming a primary transfer electric field between the photosensitive member 1*a* and the intermediate transfer belt 51 and transferring electrostatically the toner image onto the intermediate transfer belt 51.

After the toner image is primarily transferred onto the intermediate transfer belt 51, residual toner remaining on surface of the photosensitive member 1*a* is removed by a cleaning device 12*a*. Similarly, the photosensitive members 1*b*, 1*c*, and 1*d* are cleaned by cleaning devices 12*b*, 12*c*, and 12*d*, respectively.

In a full-color mode in which toner images of four different colors are formed, similar to the black toner image, a magenta toner image, a cyan toner image, and an yellow toner image are formed on the photosensitive members 1*b*, 1*c*, and 1*d*, respectively. As described above, the toner images in the colors magenta, cyan, and yellow are transferred onto the intermediate transfer belt 51, such that they are superimposed one atop the other on the black toner image which has been primarily transferred onto the intermediate transfer belt 51.

When forming a single color image of black color, such as in a monochrome mode, the primary transfer rollers 11*b*, 11*c*, and 11*d*, other than the primary transfer roller 11*a* for black, are separated from the photosensitive members 1*b*, 1*c*, and 1*d* for the colors magenta, cyan, and yellow. In a state in which only the photosensitive member 1*a* is in contact with the intermediate transfer belt 51, only the black toner image is transferred primarily onto the intermediate transfer belt 51.

As illustrated in FIG. 1, a paper feed device 14 is disposed substantially at the bottom of the main body of the image forming apparatus. The paper feed device 14 includes a feed roller 15 to pick up and send a recording medium P as a sheet-type medium in a direction indicated by an arrow B in FIG. 1. The recording medium P fed by the feed roller 15 is delivered in a predetermined timing to a secondary transfer nip at which the intermediate transfer belt 51 entrained about the repulsive roller 54 contacts a secondary transfer belt 61 of a secondary transfer device 60. The recording medium P is sent to the secondary transfer nip in appropriate timing by a pair of registration rollers 16. At this time, the repulsive roller 54 is supplied with a predetermined secondary transfer voltage to transfer secondarily the toner image from the intermediate transfer belt 51 onto the recording medium P.

In the secondary transfer device 60, the secondary transfer belt 61 serving as a first conveyor belt is entrained about and stretched taut between a secondary transfer roller 62 and a separation roller 63. According to the present illustrative embodiment, rotation of the secondary transfer roller 62 as a drive roller enables the secondary transfer belt 61 to travel in a direction indicated by a hollow arrow C in FIG. 1. The recording medium P, onto which the toner image is secondarily transferred, is carried on the outer circumferential surface of the secondary transfer belt 61 and transported while the recording medium P is absorbed electrostatically to the outer circumferential surface of the secondary transfer belt 61. Subsequently, the recording medium P separates from the surface of the secondary transfer belt 61 at the curved portion of the secondary transfer belt 61 entrained about the separation roller 63, and is transported further downstream from the secondary transfer belt 61 in a transport direction of the recording medium P by a conveyor belt 17 serving as a second conveyor belt disposed downstream from the secondary transfer belt 61.

The conveyor belt 17 is entrained about and stretched taut between a first roller 17A and a second roller 17B. The first roller 17A serves as a drive roller and as an entry roller. The second roller 17B serves as a driven roller. When the recording medium P passes through a fixing device 18 which applies heat and pressure to the toner image on the recording medium P, the toner image is fixed to the recording medium P. After the recording medium P passes through the fixing device 18, the recording medium P is discharged outside the main body through a pair of output rollers 19 of a discharge unit.

Residual toner remaining on the intermediate transfer belt 51 after the toner image is secondarily transferred therefrom is removed by a belt cleaning device 20. In the present illustrative embodiment, the belt cleaning device 20 includes a cleaning blade 21 made of suitable material, such as urethane, held against the intermediate transfer belt 51 to mechanically remove or scrape toner residues from the belt surface. Alternatively, instead of or in combination with a cleaning blade, any suitable cleaning device may be used to clean the intermediate transfer belt 51, including, for example, an electrostatic cleaning device for electrostatically removing toner residues from the belt surface.

Next, a description is provided of a belt alignment device of the secondary transfer device 60 equipped with the secondary transfer belt 61. According to the present illustrative embodiment, the belt alignment device employed in the secondary transfer device 60 is of a shaft-inclining type, and a shaft moving device 70 serves as the belt alignment device of the secondary transfer device 60 to tilt a rotary shaft of the separation roller 63 about which the secondary transfer belt 61 is entrained so as to restrict the range of misalignment of the secondary transfer belt 61 within a predetermined permissible range. The separation roller 63 is one of support rollers about which the secondary transfer belt 61 is entrained.

Figure 2:
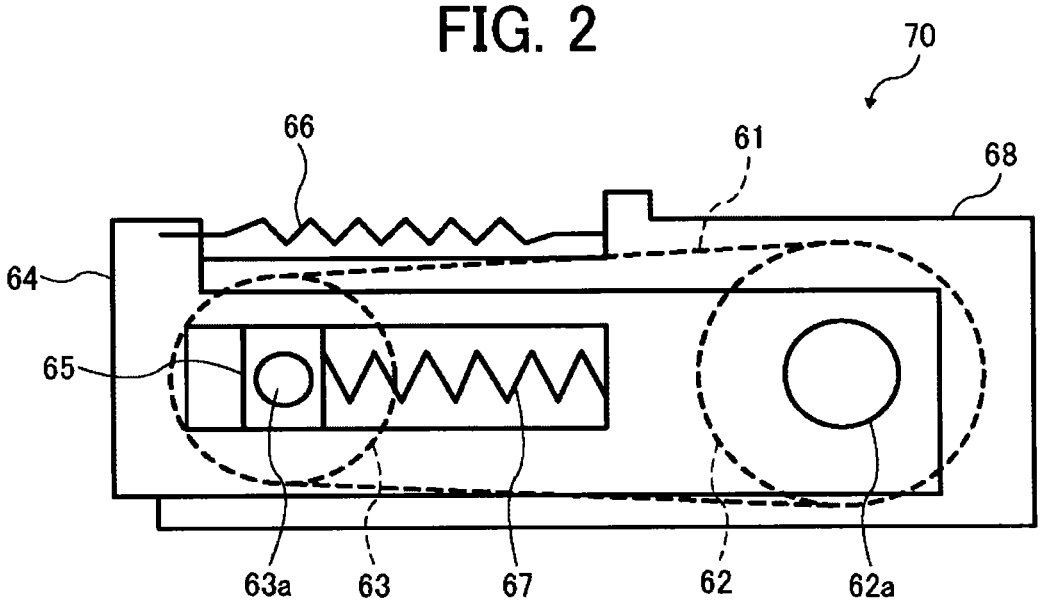
FIG. 2 is a schematic diagram illustrating a shaft moving device of a secondary transfer device employed in the image forming apparatus of FIG. 1 immediately after assembly as viewed in an axial direction of a separation roller.
Figure 3:
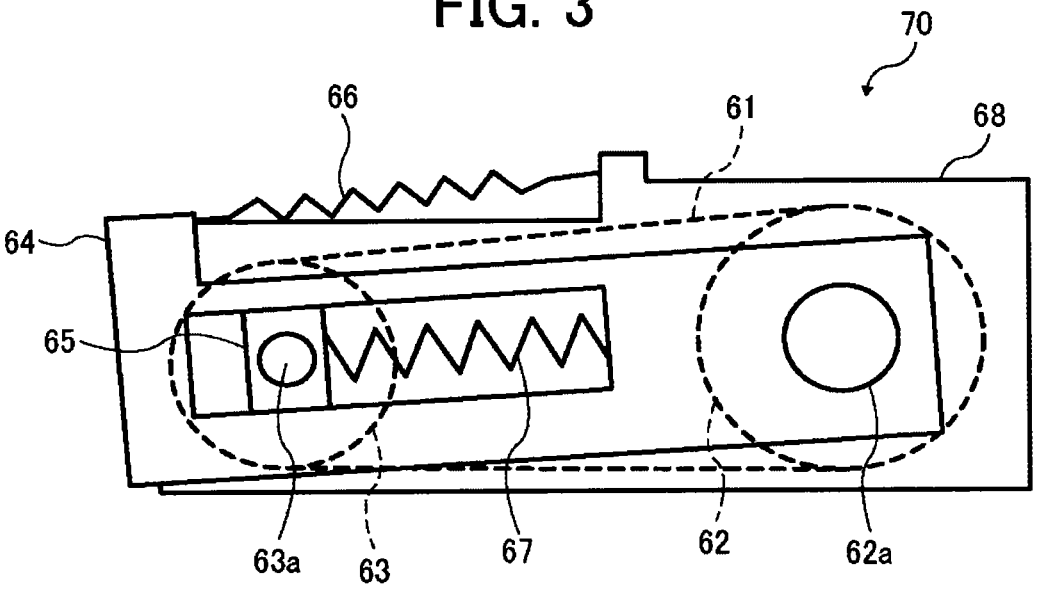
FIG. 3 is a schematic diagram illustrating the shaft moving device after adjustment of belt mistracking as viewed in the axial direction of the separation roller.

FIG. 2 is a schematic diagram illustrating the shaft moving device 70 immediately after assembly, as viewed in an axial direction of the separation roller 63. FIG. 3 is a schematic diagram illustrating the shaft moving device 70 after adjustment of misalignment of the secondary transfer belt 61 as viewed in the axial direction of the separation roller 63.

Each end of a rotary shaft 63*a* of the separation roller 63 is supported individually by different support arms 64. Each support arm 64 is rotatably attached to each end of a rotary shaft 62*a* of the secondary transfer roller 62 and biased in a clockwise direction in FIG. 2 by an arm spring 66 with one end thereof fixed to a frame 68 of the secondary transfer device 60. In a state in which there is no misalignment of the secondary transfer belt 61 immediately after assembly, a rotation position of the support arms 64 is maintained at a position at which the support arms 64 contact the frame 68 due to a bias force of the arm spring 66 as illustrated in FIG. 2.

As illustrated in FIGS. 2 and 3, each support arm 64 slidably supports a shaft bearing 65 that bears the rotary shaft 63*a* of the separation roller 63 such that the shaft bearing 65 is slidable in a radial direction from the center of rotation of the support arm 64. The shaft bearing 65 is biased outward by a tension spring 67 in the radial direction from the center of rotation of the support arms 64. With this configuration, the separation roller 63 is always biased in such a direction that the separation roller 63 separates from the secondary transfer roller 62. Accordingly, a certain tension is applied to the secondary transfer belt 61 entrained about the separation roller 63 and the secondary transfer roller 62.

Figure 4:
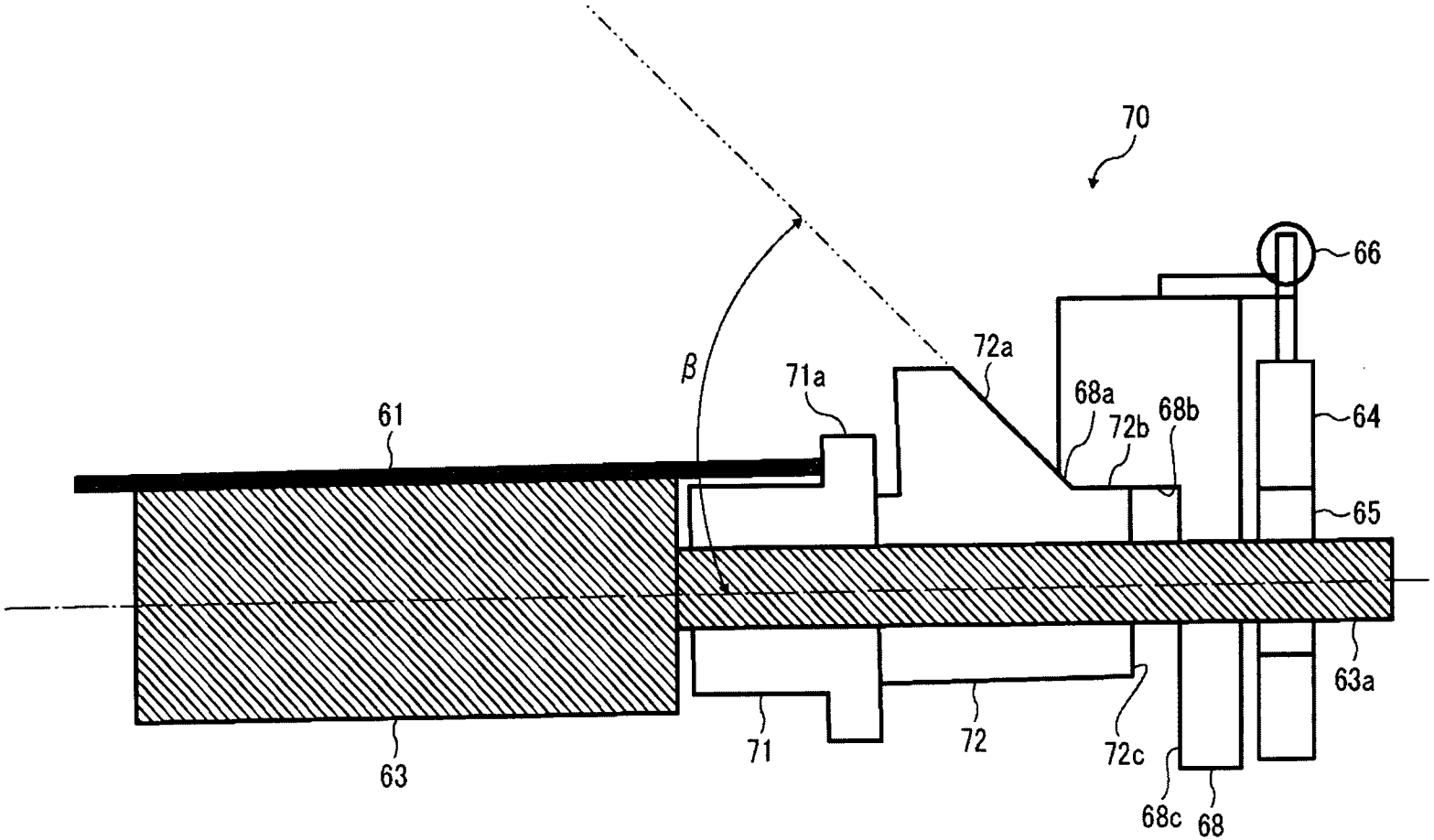
FIG. 4 is a cross-sectional diagram schematically illustrating the shaft moving device immediately after assembly, taken along a rotary shaft of the separation roller.

FIG. 4 is a cross-sectional diagram schematically illustrating the shaft moving device 70 of the secondary transfer device 60, cut along the rotary shaft 63*a* of the separation roller 63. A belt deviation detector 71 and a shaft inclining member 72 are disposed on the rotary shaft 63*a* between the separation roller 63 and the shaft bearing 65. The belt deviation detector 71 and the shaft inclining member 72 constitute an axial displacement device. The belt deviation detector 71 includes a flange 71*a* that contacts an end portion of the secondary transfer belt 61. As the secondary transfer belt 61 moves in the direction of the belt width and the end portion thereof contacts the flange 71*a*, exerting a force on the belt deviation detector 71, the belt deviation detector 71 moves outward in the axial direction along the rotary shaft 63*a* of the separation roller 63. As the belt deviation detector 71 moves outward in the axial direction along the rotary shaft 63*a*, the shaft inclining member 72 which is disposed outside the belt deviation detector 71 on the rotary shaft 63*a* moves outward in the axial direction along the rotary shaft 63*a*.

A contact portion 68*a* of the frame 68 serving as a fixation member contacts a slanted surface 72*a* of the shaft inclining member 72 from outside the rotary shaft 63*a* in the axial direction. The end portion of the rotary shaft 63*a* of the separation roller 63 on which the shaft inclining member 72 is disposed is supported, via the shaft bearing 65, by the support arm 64 which is biased by the arm spring 66. Thus, the end portion of the rotary shaft 63*a* is biased upward in FIG. 4. Accordingly, in a state in which the end portion of the secondary transfer belt 61 is not in contact with the flange 71*a* of the belt deviation detector 71, the contact position at which the contact portion 68*a* of the frame 68 and the slanted surface 72*a* of the shaft inclining member 72 contact is restricted at a position at which a first stopper surface 68*b* of the frame 68 contacts a contact surface 72*b* of the shaft inclining member 72 due to the spring force of the arm spring 66.

The contact surface 72*b* of the shaft inclining member 72 is continuously formed at the lower end of the slanted surface 72*a*. That is, the contact portion 68*a* of the frame 68 is held in a state in which the contact portion 68*a* contacts the lower end portion of the slanted surface 72*a* of the shaft inclining member 72.

Figure 5:
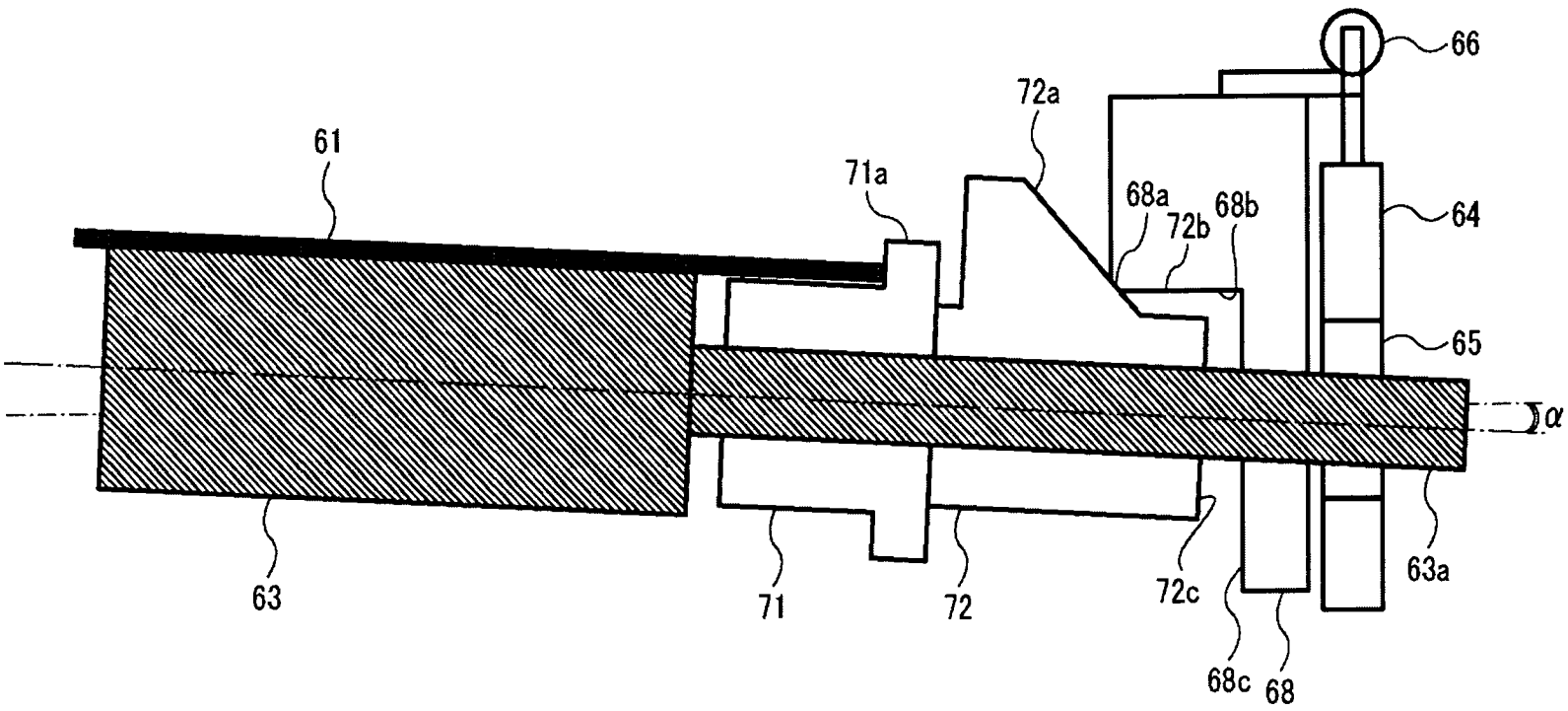
FIG. 5 is a cross-sectional diagram schematically illustrating the shaft moving device after adjustment of the belt mistracking, taken along the rotary shaft of the separation roller.

In this state, the secondary transfer belt 61 receives a force causing the secondary transfer belt 61 to move in the width direction of the belt, thereby moving the belt deviation detector 71 and the slanted member 72 outward in the axial direction along the rotary shaft 63*a*. As a result, the contact portion 68*a* of the frame 68 relatively moves along the slanted surface 72*a* of the shaft inclining member 72. Thus, the contact position at which the slanted surface 72*a* of the shaft inclining member 72 and the contact portion 68*a* of the frame 68 contact shifts to the upper side of the slanted surface 72*a*. As a result, the axial end portion of the rotary shaft 63*a* of the separation roller 63 in the moving direction of the secondary transfer belt 61 is pressed down against the biasing force of the arm spring 66 as illustrated in FIG. 5.

At this time, the end portion of the secondary transfer belt 61 is not in contact with the flange 71*a* of the belt deviation detector 71. Accordingly, as illustrated in FIG. 4, the contact portion 68*a* of the frame 68 is held in a state in which the contact portion 68*a* of the frame 68 contacts the lower end portion of the slanted surface 72*a* of the shaft inclining member 72. Therefore, the opposite end of the rotary shaft 63*a* of the separation roller 63, which is the opposite end in the moving direction of the secondary transfer belt 61, is pressed down relative to the other end, causing the rotary shaft 63*a* to tilt.

As the rotary shaft 63*a* of the separation roller 63 tilts further, a moving speed of the secondary transfer belt 61 in the width direction of the belt slows down gradually, and ultimately, the secondary transfer belt 61 starts to move in the direction opposite to the width direction of the belt. As a result, the position of the secondary transfer belt 61 in the width direction returns gradually, thereby enabling the secondary transfer belt 61 to travel reliably at a position at which the belt mistracking is corrected. The same is true for the case in which the direction of shift of the secondary transfer belt 61 is in the direction opposite to the direction described above.

Figure 6:
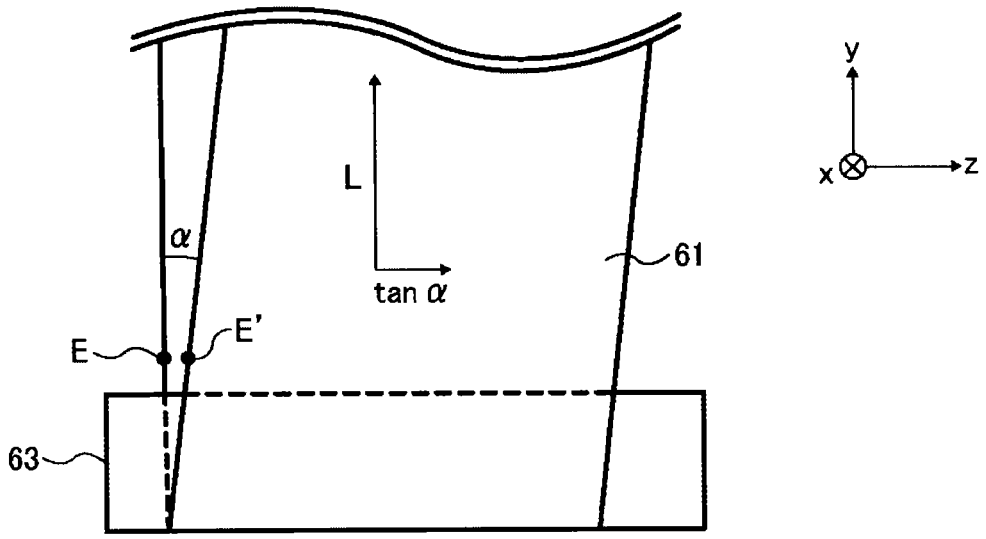
FIG. 6 is a conceptual diagram illustrating a belt skew of a secondary transfer belt.

With reference to FIG. 6, a description is provided of a principle of correction of belt mistracking by tilting the rotary shaft 63*a* of the separation roller 63. FIG. 6 is a conceptual diagram illustrating mistracking of the secondary transfer belt 61. Here, it is assumed that the secondary transfer belt 61 is a rigid body, and an arbitrary point (i.e., a point E on the belt end portion) on the secondary transfer belt 61 before advancing to the separation roller 63 is observed. As long as the secondary transfer belt 61 entrained about and stretched taut between two rollers, i.e., the secondary transfer roller 62 and the separation roller 63, is completely horizontal or parallel, the position of the secondary transfer belt 61 in the axial direction of the separation roller 63 does not change between the point E on the secondary transfer belt 61 immediately before entering the separation roller 63 and a point E' corresponding to the point E immediately after exiting the separation roller 63. In this case, the secondary transfer belt 61 does not travel out of alignment.

By contrast, in a case in which the rotary shaft 63*a* of the separation roller 63 is inclined at an inclination angle $\alpha$ relative to the rotary shaft 62*a* of the secondary transfer roller 62, the point E on the secondary transfer belt 61 shifts by an amount of tan $\alpha$ in the axial direction of the separation roller 63 while moving along the peripheral surface of the separation roller 63 as illustrated in FIG. 6. Therefore, by tilting the rotary shaft 63*a* of the separation roller 63 at the inclination angle $\alpha$ relative to the rotary shaft 62*a* of the secondary transfer roller 62, the position of the secondary transfer belt 61 in the width direction of the belt can be moved approximately by the amount of tan $\alpha$ in accordance with the rotation of the separation roller 63.

The amount of belt mistracking (moving speed in the width direction of the belt) of the secondary transfer belt 61 is proportional to the inclination angle $\alpha$. That is, the greater is the inclination angle $\alpha$, the greater is the amount of mistracking of the secondary transfer belt 61. The smaller is the inclination angle $\alpha$, the smaller is the amount of mistracking of the secondary transfer belt 61. For example, in a case in which the secondary transfer belt 61 wanders to the right side as illustrated in FIG. 5, this belt mistracking causes the shaft inclining member 72 to move in the axial direction of the separation roller 63, thereby moving the rotary shaft 63*a* of the separation roller 63 down in FIG. 5 and thus moving the secondary transfer belt 61 to the left in FIG. 5. With this configuration, the rotary shaft 63*a* of the separation roller 63 is inclined to move the secondary transfer belt 61 in the opposite direction to the direction of the initial belt mistracking, thereby compensating the initial belt mistracking.

In other words, the secondary transfer belt 61 is moved to a place at which the initial belt mistracking and the displacement of the secondary transfer belt 61 caused by the inclination of the rotary shaft 63*a* are balanced, thereby correcting the belt mistracking. In the event in which the secondary transfer belt 61 traveling at the balanced position wanders to either side, the inclination of the rotary shaft 63*a* of the separation roller 63 in accordance with the belt mistracking brings the secondary transfer belt 61 to the balanced position again.

According to the present illustrative embodiment, the shaft moving device 70 of the secondary transfer device 60 tilts the rotary shaft 63*a* of the separation roller 63 at an inclination angle corresponding to the moving amount of the secondary transfer belt 61 in the width direction of the belt. The belt mistracking of the secondary transfer belt 61 can be corrected fast. Furthermore, in order to tilt the rotary shaft 63*a* of the separation roller 63, the moving force of the secondary transfer belt 61 moving in the width direction of the belt is used so that an additional drive source such as a motor is not necessary and hence no space is needed to accommodate such a drive source. The rotary shaft 63*a* of the separation roller 63 can be tilted with a simple configuration without a dedicated drive source.

Figure 7:
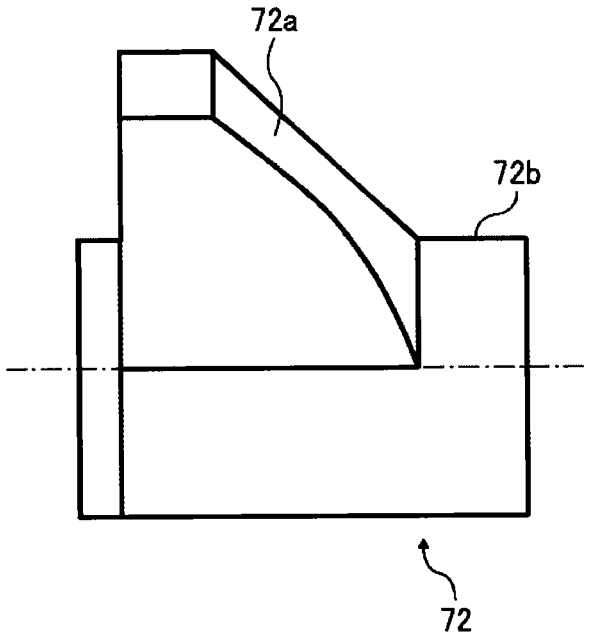
FIG. 7 is a perspective view schematically illustrating a shaft inclining member of the shaft moving device.

Next, with reference to FIG. 7, a description is provided of the shaft inclining member 72. FIG. 7 is a perspective view schematically illustrating the shaft inclining member 72 according to an illustrative embodiment of the present disclosure. According to the present illustrative embodiment, the shaft inclining member 72 includes the slanted surface 72*a* on an outer circumferential surface of a cylindrical main body of the shaft inclining member 72. The slanted surface 72*a* is formed of a curved surface that constitutes a part of the circumference of a conical shape, the center of which coincides with the center axis of the cylindrical main body.

There are two reasons for forming the slanted surface 72*a* with a curved surface. The first reason is that even when the shaft inclining member 72 rotates slightly around the rotary shaft 63*a* of the separation roller 63, the angle of inclination of the separation roller 63 does not change. The second reason is that the curved surface of the slanted surface 72*a* allows the slanted surface 72*a* and the contact portion 68*a* of the frame 68 to make a point contact, thereby reducing friction at the contact place. With this configuration, the contact pressure at the end portion of the secondary transfer belt 61 contacting the belt deviation detector 71 is reduced, thereby reducing damage to the end portion of the secondary transfer belt 61 and hence achieving extended belt life expectancy.

According to the present illustrative embodiment, the slanted surface 72*a* is tilted at an inclination angle $\beta$ of approximately 30° relative to the rotary shaft 63*a*. Preferred material of the shaft inclining member 72 includes, but is not limited to, polyacetal (POM).

A bending stress acts repeatedly on the end portion of the secondary transfer belt 61 due to contact with the belt deviation detector 71, thus resulting in damage or breakage of the secondary transfer belt 61. For this reason, preferably, a reinforcing tape is adhered around the inner and outer circumferential surfaces at the end of the secondary transfer belt 61.

A description is provided of an example configuration of the separation roller 63 and the secondary transfer belt 61. The diameter of the separation roller 63 is approximately $\phi$15. The material thereof is aluminum.

The material of the secondary transfer belt 61 is polyimide. Young's modulus of the secondary transfer belt 61 is approximately 3000 MPa. Folding endurance of the secondary transfer belt 61 measured by the MIT-type folding endurance tester is approximately 6000 times. The thickness of the secondary transfer belt 61 is approximately 80 μm. The linear velocity of the secondary transfer belt 61 is approximately 352 mm/s.

The belt tension is approximately 0.9 N/cm. It is to be noted that the folding endurance measurement by the MIT-type folding endurance tester conforms to the Japanese Industrial Standard (JIS) P8115. More specifically, the measuring conditions of the folding endurance testing are as follows: Testing load: 1 kgf; Flexion angle: 135 degrees; and Flexion speed 175 times per minute.

Material of the conveyor belt 17 of the present illustrative embodiment includes, but is not limited to, Ethylene Propylene Diene Monomer (EPDM), and the thickness thereof is, for example, 1 mm.

Next, a description is provided of a restriction mechanism that restricts a degree of inclination of the rotary shaft 63*a* of the separation roller 63 according to the illustrative embodiment of the present disclosure. According to the present illustrative embodiment, the restriction mechanism limits the outward movement of the shaft inclining member 72 in the axial direction to a certain range so that the degree of inclination of the rotary shaft 63*a* of the separation roller 63 is restricted. More specifically, an outer end surface 72*c* of the shaft inclining member 72 in the axial direction comes into contact with a second stopper surface 68*c* of the frame 68, thereby preventing the shaft inclining member 72 from moving further outward in the axial direction.

In the present illustrative embodiment, the second stopper surface 68*c* of the frame 68 restricts the outward movement of the shaft inclining member 72 in the axial direction. Alternatively, the support arm 64 and the shaft bearing 65 may restrict the outward movement of the shaft inclining member 72 in the axial direction. The degree of inclination of the rotary shaft 63*a* of the separation roller 63 is adjusted not only by restricting the outward movement of the shaft inclining member 72 in the axial direction, but may be restricted directly or may be restricted using any other suitable restriction devices.

In a case in which the degree of inclination of the rotary shaft 63*a* of the separation roller 63 is too large, the leading end of the recording medium P separated from the secondary transfer belt 61 may not land smoothly on the outer circumferential surface of the conveyor belt 17. If the leading end of the recording medium P does not land smoothly on the outer circumferential surface of the conveyor belt 17, a significant shock is applied to the recording medium P bearing an unfixed toner image, causing image failure in the toner image and paper jams. When the rotary shaft 63*a* of the separation roller 63 tilts, the position of the leading end of the recording medium P separated from the secondary transfer belt 61, arriving at the outer circumferential surface of the conveyor belt 17 changes.

Although the leading end of the recording medium P lands on the outer circumferential surface of the conveyor belt 17 smoothly when the degree of inclination of the rotary shaft 63*a* of the separation roller 63 is relatively small, the leading end of the recording medium P may not land on the outer circumferential surface of the conveyor belt 17 smoothly when the degree of inclination of the rotary shaft 63*a* of the separation roller 63 is relatively large.

In view of the above, according to the present illustrative embodiment, the degree of inclination of the rotary shaft 63*a* of the separation roller 63 is regulated within a range in which the leading end of the recording medium P can land smoothly on the outer circumferential surface of the conveyor belt 17. A more detailed description is provided with reference to FIGS. 8 and 9.

Figure 8:
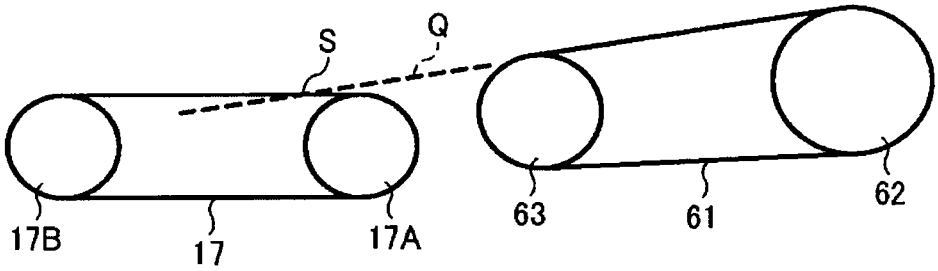
FIG. 8 is a schematic diagram illustrating the secondary transfer belt and a conveyor belt immediately after assembly, as viewed in the axial direction of a rotary shaft of the secondary transfer roller.
Figure 9:
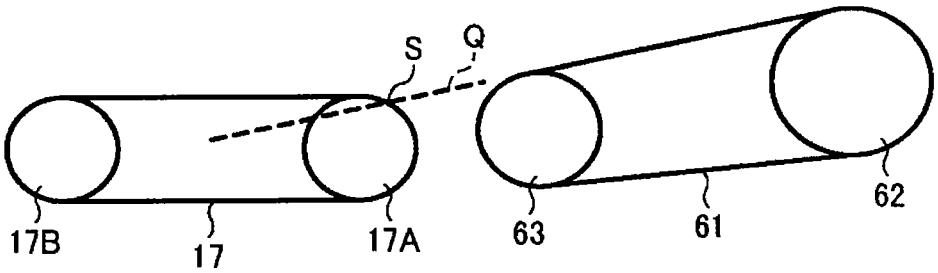
FIG. 9 is a schematic diagram illustrating the secondary transfer belt and the conveyor belt when inclination of the separation roller is at its maximum, as viewed in the axial direction of the rotary shaft of the secondary transfer roller.

FIG. 8 is a schematic diagram illustrating the secondary transfer belt 61 and the conveyor belt 17 as viewed in the axial direction of the rotary shaft 62*a* of the secondary transfer roller 62 immediately after assembly. FIG. 9 is a schematic diagram illustrating the secondary transfer belt 61 and the conveyor belt 17 as viewed in the axial direction of the rotary shaft 62*a* of the secondary transfer roller 62 when the inclination of the separation roller 63 is at its maximum.

According to the present illustrative embodiment, the outer end surface 72*c* of the shaft inclining member 72 in the axial direction comes into contact with the second stopper surface 68*c* of the frame 68, thereby preventing the shaft inclining member 72 from moving further outward in the axial direction. As illustrated in FIG. 9, the degree of inclination of the rotary shaft 63*a* of the separation roller 63 is at its maximum. According to the present illustrative embodiment, even when the degree of inclination of the rotary shaft 63*a* of the separation roller 63 is at its maximum, a hypothetical extended plane Q is configured not to contact the rotational center axis of the first roller 17A supporting the conveyor belt 17 as illustrated in FIG. 9. The hypothetical extended plane Q is a hypothetical extension of an outer circumferential surface (hereinafter referred to as a recording medium bearing surface) of the secondary transfer belt 61 stretched taut between the separation roller 63 and the secondary transfer roller 62 disposed upstream from the separation roller 63 in the traveling direction of the secondary transfer belt 61, extending to the downward side in the transport direction of the recording medium P. In other words, in the present illustrative embodiment, the hypothetical extended plane Q is configured to be positioned always above the rotational center axis of the first roller 17A (that is, at the outer circumferential side, i.e., the recording medium bearing surface of the conveyor belt 17 on which the recording medium P is carried).

In general, the leading end side of the recording medium P separated from the secondary transfer belt 61 comes into contact with the outer circumferential surface of the wound portion of the conveyor belt 17 wound around the first roller 17A, and then moves in the traveling direction of the conveyor belt 17 while the leading end side of the recording medium P remains contacting the outer circumferential surface of the conveyor belt 17 at the contact point. Immediately after the leading end side of the recording medium P comes into contact with the outer circumferential surface of the wound portion of the conveyor belt 17, the contact point shifts along the circumferential surface of the first roller 17A.

Figure 10:
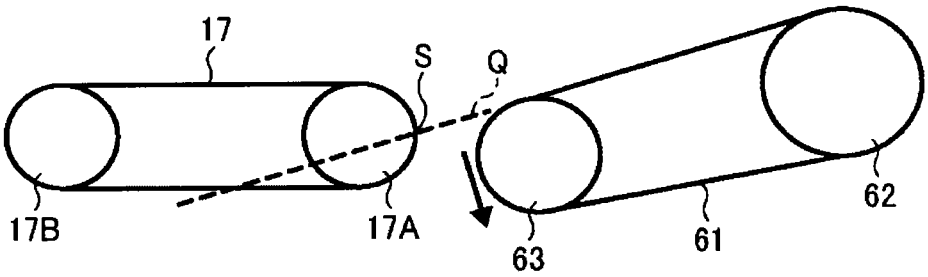
FIG. 10 is a schematic diagram illustrating the secondary transfer belt and the conveyor belt as viewed in the axial direction of the rotary shaft of the secondary transfer roller when the inclination of the separation roller is at its maximum and a hypothetical extension plane Q contacts or crosses a rotary shaft of a first roller of the conveyor belt.

For example, assuming that when the degree of inclination of the rotary shaft 63*a* of the separation roller 63 is at its maximum as illustrated in FIG. 10 the hypothetical extended plane Q of the secondary transfer belt 61 contacts (or crosses) the rotational center axis of the first roller 17A of the conveyor belt 17. In this case, the contact point, at which at least one end portion (frontal side in FIG. 10) of the separation roller 63 and the outer circumferential surface of the conveyor belt 17 wound around the first roller 17A contact, shifts to the trailing edge side of the recording medium P immediately after contact because the contact point moves along the circumferential surface of the first roller 17A. In this configuration, the leading end side of the recording medium P receives an external force in such a manner that the leading end side of the recording medium P is pushed back to the upstream side in the transport direction of the recording medium P immediately after the recording medium P contacts the wound portion of the conveyor belt 17 around the first roller 17A, thereby hindering smooth landing of the leading end of the recording medium P on the outer circumferential surface of the conveyor belt 17.

By contrast, according to the present illustrative embodiment, even when the degree of inclination of the rotary shaft 63*a* of the separation roller 63 is at its maximum, the hypothetical extended plane Q of the secondary transfer belt 61 does not contact (or cross) the rotational center axis of the first roller 17A of the conveyor belt 17. With this configuration, the contact point at which the leading end side of the recording medium P and the outer circumferential surface of the wound portion of the conveyor belt 17 wound around the first roller contact shifts to the downstream side in the transport direction of the recording medium P over the entire area of the leading end side of the recording medium immediately after contact. Thus, immediately after the leading end side of the recording medium P contacts the wound portion of the conveyor belt 17, the leading end side of the recording medium P does not receive the external force which pushes the leading end of the recording medium back to the upstream side in the transport direction of the recording medium P (i.e., the trailing edge side of the recording medium P), thereby allowing the leading end of the recording medium P to land smoothly on the outer circumferential surface of the conveyor belt 17.

In the event of double sided printing, the leading end of the recording medium P carried on the secondary transfer belt 61 may be curled a little. In this case, if the hypothetical extended plane Q of the secondary transfer belt 61 is positioned slightly above the rotational center axis of the first roller 17A of the conveyor belt 17 when the degree of inclination of the rotary shaft 63*a* of the separation roller 63 is at its maximum, the curled portion of the recording medium P at the leading end thereof may contact the outer circumferential surface of the conveyor belt 17 at the position upstream from the position for the normal case in which the recording medium P is not curled in the transport direction of the recording medium P. Immediately after the leading end portion of the curled portion of the recording medium P contacts the conveyor belt 17, the leading end portion of the curled portion of the recording medium P may receive the external force that pushes the recording medium P back to the upstream side in the transport direction of the recording medium P (the trailing end side of the recording medium P), hindering smooth landing of the leading end of the recording medium P on the outer circumferential surface of the conveyor belt 17.

Figure 11:
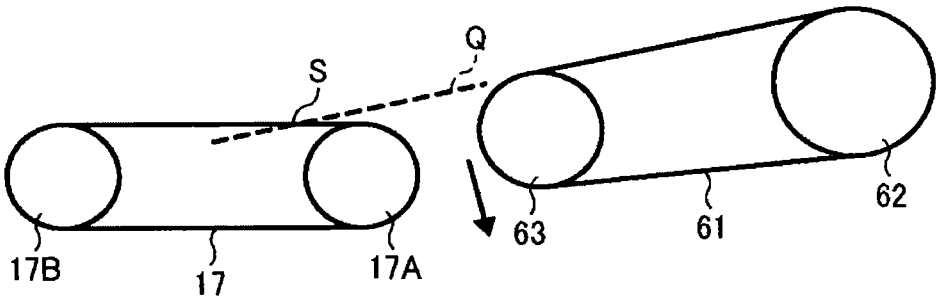
FIG. 11 is a schematic diagram illustrating the secondary transfer belt and the conveyor belt as viewed in the axial direction of the rotary shaft of the secondary transfer roller when the inclination of the separation roller is at its maximum, according to another illustrative embodiment of the present disclosure.

In view of the above, as illustrated in FIG. 11, when the degree of inclination of the rotary shaft 63*a* of the separation roller 63 is at its maximum, an intersection point S at which the hypothetical extended plane Q crosses the outer circumferential surface of the conveyor belt 17 is set to be at the position downstream from the intersection point S shown in FIG. 9 in the traveling direction of the conveyor belt 17. With this configuration, even when the leading end of the recording medium P is curled, the leading end of the recording medium P can land smoothly on the outer circumferential surface of the conveyor belt 17.

Figure 12:
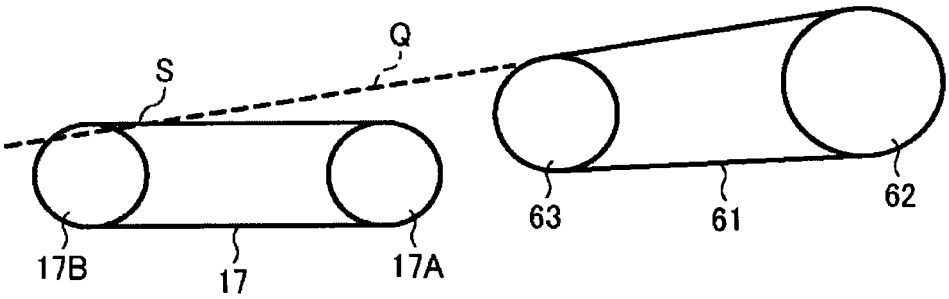
FIG. 12 is a schematic diagram illustrating the secondary transfer belt and the conveyor belt immediately after assembly, as viewed in the axial direction of the rotary shaft of the secondary transfer roller, according to still another illustrative embodiment of the present disclosure.

As illustrated in FIG. 12, by setting the intersection point S at which the hypothetical plane Q crosses the outer circumferential surface of the conveyor belt 17 to be at a position downstream from the intersection point S shown in FIG. 8 in the traveling direction of the conveyor belt 17 immediately after assembly (in a state in which no belt mistracking is present), a permissible range in which the separation roller 63 can tilt is not narrow, thereby enhancing belt tracking.

In the present illustrative embodiment of the present disclosure, a description is provided of delivery of the recording medium P between the secondary transfer belt 61 and the conveyor belt 17. However, the present disclosure is not limited to the configuration described above and can be applied to a configuration in which a sheet-type medium is delivered from a first conveyor belt to a second conveyor belt disposed downstream from the first conveyor belt. In the present illustrative embodiment of the present disclosure, the shaft moving device 70 which does not require a drive source to tilt the separation roller 63 and thus is simple is employed as an example of a belt alignment device. However, the belt alignment device is not limited to the configuration described above. Any other suitable belt alignment devices using the shaft inclining method may be employed.

The various configurations according to the present disclosure can attain specific effects as follows.

(Aspect A)

A conveyor system includes a first conveyor belt such as the secondary transfer belt 61 formed into an endless loop, and entrained about and stretched taut a plurality of rollers including drive rollers such as the secondary transfer roller 62, a separation roller such as the separation roller 63 including a rotary shaft and a support roller such as the secondary transfer roller 62 disposed upstream from the separation roller in a traveling direction of the first conveyor belt, to carry a sheet-type medium on an outer circumferential surface of the first conveyor belt; a second conveyor belt such as the conveyor belt 17 formed into an endless loop, and entrained about and stretched taut between a plurality of rollers including a first roller such as the first roller 17A (drive roller) disposed at an uppermost stream in a transport direction of the sheet-type medium and a second roller such as the second roller 17B (driven roller) disposed downstream from the first roller, to carry, on an outer circumferential surface of the second conveyor belt, the sheet-type medium separated from a wound portion of the first conveyor belt wound around the separation roller; a belt alignment device such as the shaft moving device 70 to tilt the rotary shaft of the separation roller to restrict a range of belt mistracking of the first conveyor belt in a width direction of the first conveyor belt within a predetermined range; and a restriction member such as the contact surface 72*b* and the first stopper surface 68*b* to restrict an amount of inclination of the rotary shaft of the separation roller such that a hypothetical extended plane, i.e., the hypothetical plane Q which is a hypothetical extension of the outer circumferential surface of the first conveyor belt between the separation roller and the support roller to a downstream side in the transport direction does not contact a rotational center axis of the first roller.

In general, the leading end of the sheet-type medium separated from the first conveyor belt normally contacts the outer circumferential surface of the wound portion of the second conveyor belt wound around the first rotary member or the outer circumferential surface of the second conveyor belt downstream from the first rotary member in the traveling direction of the belt. Subsequently, the leading end of the sheet-type medium moves in the traveling direction of the belt while contacting the outer circumferential surface of the second conveyor belt at the contact point in accordance with traveling of the second conveyor belt. At this time, for example, in a case in which the leading end side of the sheet-type medium contacts the outer circumferential surface of the wound portion of the second conveyor belt wound around the first roller, the contact point shifts along the circumferential surface of the first roller immediately after contact.

Assuming that when the degree of inclination of the rotary shaft of the separation roller is at its maximum the hypothetical extended plane of the first conveyor belt contacts (or crosses) the rotational center axis of the first roller of the second conveyor belt. In this case, the contact point, at which a portion of the leading end side of the sheet-type medium and the outer circumferential surface of the wound portion of the second conveyor belt wound around the first roller contact, shifts to the trailing edge side of the sheet-type medium immediately after contact. As a result, the leading end side of the sheet-type medium receives an external force in such a manner that the leading end side of the sheet-type medium is pushed back to the upstream side (the trailing end side of the sheet-type medium) in the transport direction of the sheet-type medium immediately after the portion of the leading end side of the sheet-type medium contacts the wound portion of the second conveyor belt, thereby hindering smooth landing of the leading end of the sheet-type medium on the outer circumferential surface of the second conveyor belt.

By contrast, according to the present illustrative embodiment, even when the degree of inclination of the rotary shaft of the separation roller is at its maximum, the hypothetical extended plane of the first conveyor belt does not contact (or cross) the rotational center axis of the first roller of the second conveyor belt. With this configuration, the contact point at which the leading end side of the sheet-type medium and the outer circumferential surface of the wound portion of the second conveyor belt wound around the first roller contact shifts towards the downstream side in the transport direction of the sheet-type medium over the entire area of the leading end side of the sheet-type medium immediately after contact. Thus, immediately after the leading end side of the sheet-type medium contacts the wound portion of the second conveyor belt, the leading end side of the sheet-type medium does not receive the external force which pushes the leading end of the sheet-type medium back to the upstream side (the trailing end side of the sheet-type medium) in the transport direction of the sheet-type medium, thereby allowing the leading end of the sheet-type medium to land smoothly on the outer circumferential surface of the second conveyor belt and hence preventing image failure on the sheet-type medium and paper jams.

(Aspect B)

According to Aspect A, in the conveyor system the restriction member restricts the amount of inclination of the rotary shaft of the separation roller within a range in which the hypothetical extended plane Q crosses the outer circumferential surface (sheet bearing surface) of the second conveyor belt between the first roller and the second roller.

With this configuration, even when the leading end of the sheet-type medium is curled, the leading end of the sheet-type medium can land smoothly on the outer circumferential surface of the second conveyor belt.

(Aspect C)

According to Aspect A or B, the belt alignment device is disposed at a shaft end portion of the separation roller and includes an axial displacement device such as the belt deviation detector 71 and the shaft inclining member 72 to move along the rotary shaft 62*a* of the separation roller to one end of the rotary shaft in the width direction of the first conveyor belt as the first conveyor belt receives a force causing the first conveyor belt to move in the width direction of the first conveyor belt; and a fixation member such as the contact portion 68*a* of the frame 68 to contact the axial displacement device from the one end in the width direction of the first conveyor belt. At least one of the axial displacement device and the fixation member includes a slanted surface, i.e., the slanted surface 72*a* that contacts another of the axial displacement device and the fixation member, and as the first conveyor belt receives the force causing the first conveyor belt to move in the width direction of the first conveyor belt and the axial displacement device moves along the slanted surface relative to the fixation member, thereby changing a position of the shaft end portion of the separation roller, the rotary shaft of the separation roller tilts.

With this configuration, the rotary shaft of the separation roller can be tilted at an inclination angle corresponding to the travel amount of the first conveyor belt in the width direction of the first conveyor belt. Displacement of the first conveyor belt is corrected fast. Furthermore, the conveyor unit does not necessitate a drive source to tilt the separation roller, thereby achieving simplification of the structure.

(Aspect D)

An image forming apparatus includes a latent image bearing member such as the photosensitive members 1*a*, 1*b*, 1*c*, and 1*d* to bear an image on a surface thereof; an intermediate transfer member such as the intermediate transfer belt 51 onto which the image is transferred from the latent image bearing member; and the conveyor system according to claim 1 to transport a sheet-type medium onto which the image is transferred from the intermediate transfer member.

With this configuration, image failure and paper jams are prevented.

(Aspect E)

According to Aspect D, the image forming apparatus includes a primary transfer device such as the primary transfer rollers 11*a*, 11*b*, 11*c*, and 11*d* to primarily transfer the image formed on the latent image bearing member onto the intermediate transfer member; and a secondary transfer device such as the secondary transfer device 60 to secondarily transfer the image on the intermediate transfer member onto the sheet-type medium carried on the outer circumferential surface of the first conveyor belt.

With this configuration, in an image forming apparatus using the intermediate transfer method, image failure and paper jams are prevented.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A image forming apparatus, comprising:

a transfer belt formed into an endless loop, entrained about and stretched taut between a plurality of rollers including a separation roller including a rotary shaft and a support roller disposed upstream from the separation roller in a traveling direction of the transfer belt, to carry a sheet-type medium on an outer circumferential surface of the transfer belt;

a conveyor belt formed into an endless loop, entrained about and stretched taut between a plurality of rollers including a first roller disposed at an uppermost stream in a transport direction of the sheet-type medium and a second roller disposed downstream from the first roller, to carry, on an outer circumferential surface of the conveyor belt, the sheet-type medium separated from a wound portion of the transfer belt wound around the separation roller;

a belt alignment device to tilt the rotary shaft of the separation roller to restrict a range of belt mistracking of the transfer belt in a width direction of the transfer belt within a predetermined range; and a restriction member to restrict an amount of inclination of the rotary shaft of the separation roller such that a hypothetical extended plane, which is a hypothetical extension of the outer circumferential surface of the transfer belt between the separation roller and the support roller to a downstream side in the transport direction, does not contact a rotational center axis of the first roller.

2. The image forming apparatus according to claim 1, wherein the restriction member restricts the amount of inclination of the rotary shaft of the separation roller within a range in which the hypothetical extended plane crosses the outer circumferential surface of the conveyor belt between the first roller and the second roller.

3. The image forming apparatus according to claim 1, wherein the belt alignment device is disposed at a shaft end portion of the separation roller and includes an axial displacement device to move along the rotary shaft of the separation roller to one end of the rotary shaft in the width direction of the transfer belt upon receiving a force causing the transfer belt to move in the width direction of the transfer belt, and a fixation member to contact the axial displacement device from the one end in the width direction of the transfer belt, wherein at least one of the axial displacement device and the fixation member includes a slanted surface that contacts another of the axial displacement device and the fixation member, and upon receiving the force causing the transfer belt to move in the width direction of the transfer belt the axial displacement device moves along the slanted surface relative to the fixation member to change a position of the shaft end portion of the separation roller and tilt the rotary shaft of the separation roller.

* * * * *